US005110051A

United States Patent [19]

Bennett

[11] Patent Number: 5,110,051

[45] Date of Patent: May 5, 1992

[54] SQUEEZE SPRAYER DEVICE

[76] Inventor: Robert A. Bennett, 170 Sturbridge Rd., Easton, Conn. 06612

[21] Appl. No.: 663,173

[22] Filed: Mar. 1, 1991

[51] Int. Cl.[5] ..... B65D 1/32

[52] U.S. Cl. ..... 239/327; 239/411; 222/211; 222/212; 222/496

[58] Field of Search ..... 239/327, 310, 533.1, 239/339, 353, 354, 410, 411, 412; 222/496, 209, 211, 212, 402.18, 481.5

[56] References Cited

U.S. PATENT DOCUMENTS

| | | | |
|---|---|---|---|
| 1,977,500 | 10/1934 | Tierman | 222/496 |
| 2,609,235 | 9/1952 | Reimann | 239/354 |
| 2,631,064 | 3/1953 | Tupper | 239/354 |
| 2,764,453 | 9/1956 | Robb et al. | 239/354 |
| 2,796,294 | 6/1957 | McKinnon | 239/354 |
| 3,361,304 | 1/1968 | Thompson | 239/327 |
| 3,401,845 | 9/1968 | Bach | 239/327 |
| 4,087,023 | 5/1978 | Szczepanski | 222/212 |
| 4,102,476 | 7/1978 | Loeffler | 222/212 |
| 4,162,749 | 7/1979 | Bennett | 222/212 |
| 4,186,882 | 2/1980 | Szczepanski | 222/212 |
| 4,773,570 | 9/1988 | Workum | 222/211 |

*Primary Examiner*—Andres Kashnikow
*Assistant Examiner*—Christopher G. Trainor

[57] ABSTRACT

A squeeze sprayer device is attached to a squeezable container of fluid. The device includes a capped cylinder containing an axially moveable discharge valve in the form of an air piston which unseats in response to air pressure to open the discharge upon squeezing the container for producing a fine mist spray as pressurized air admixes with the liquid at the discharge orifice. A one-way valve controlled air vent on the piston closes during the spray operation. Upon release of squeeze pressure, the piston returns, its one-way valve opens for venting, and the piston seal cuts off the spray.

28 Claims, 2 Drawing Sheets

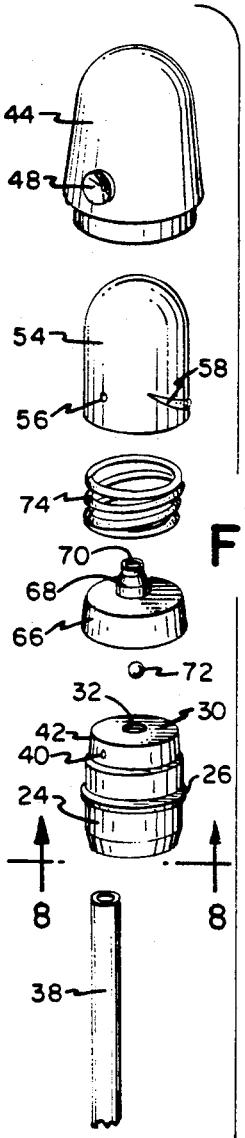
FIG. 1
FIG. 3
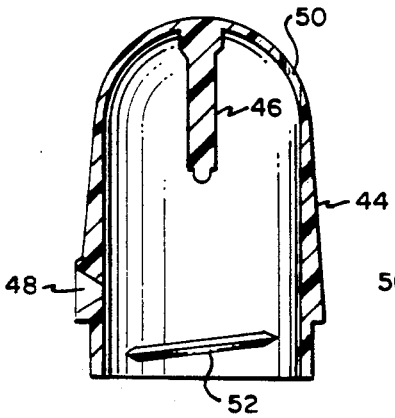
FIG. 5
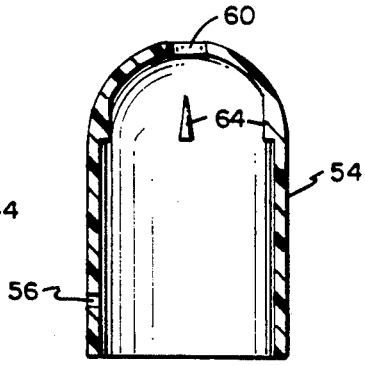
FIG. 2
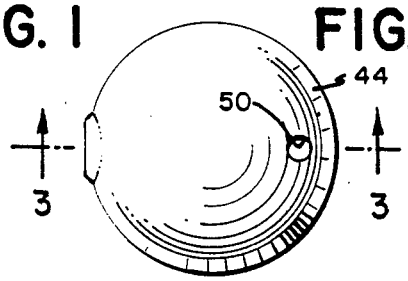
FIG. 4
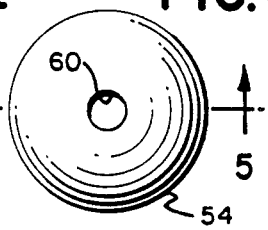
FIG. 6
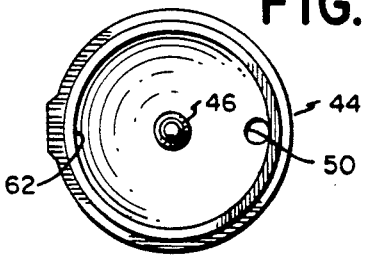
FIG. 7
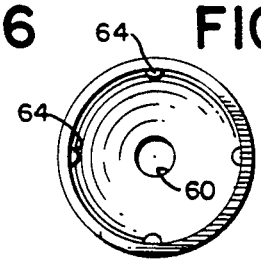
FIG. 15
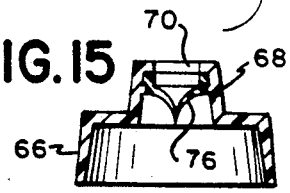
FIG. 17
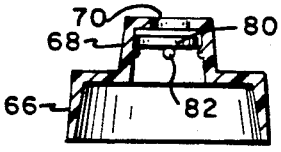
FIG. 8
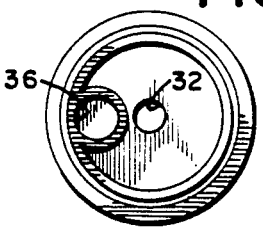
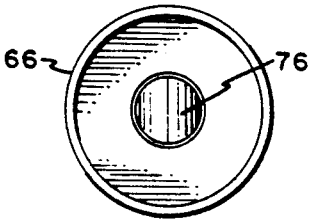
FIG. 16
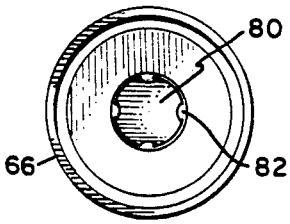
FIG. 18

FIG. 9
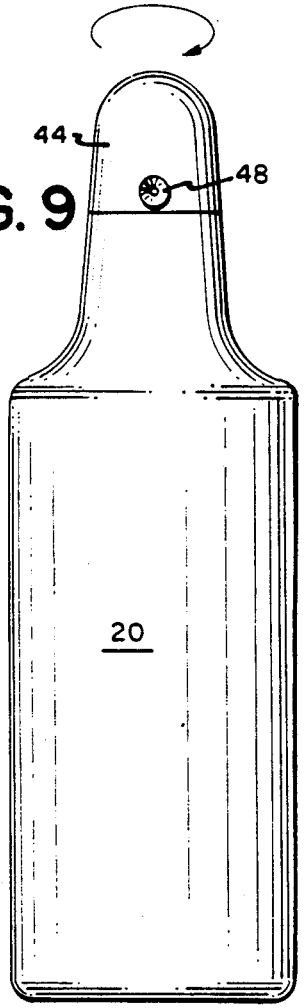
FIG. 11
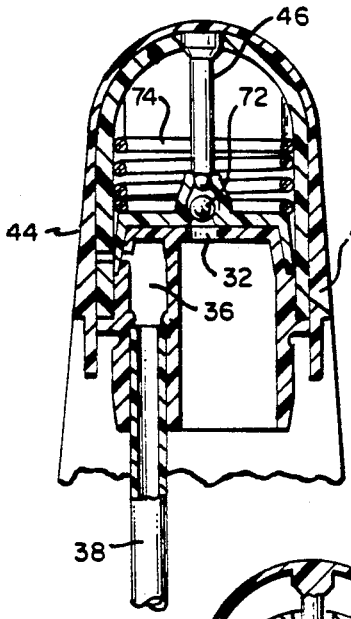
FIG. 12
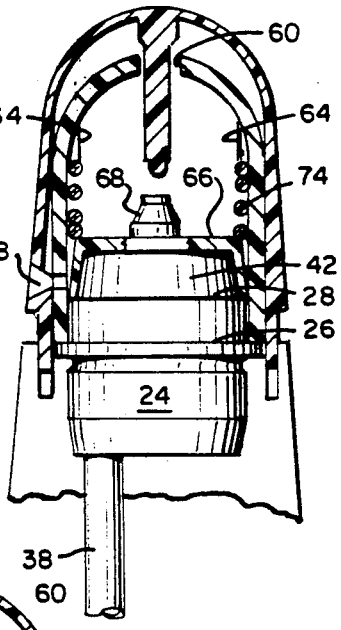
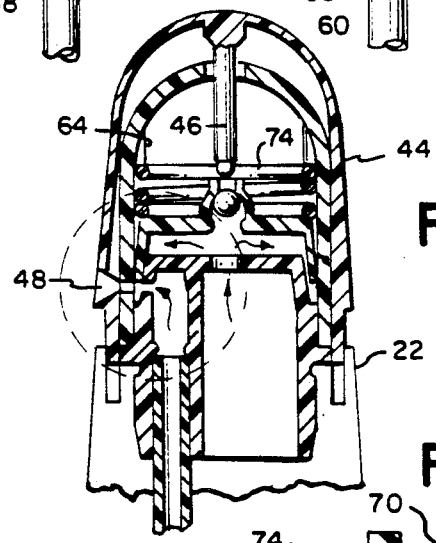
FIG. 13
FIG. 10
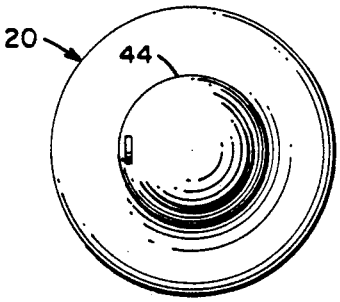
FIG. 14
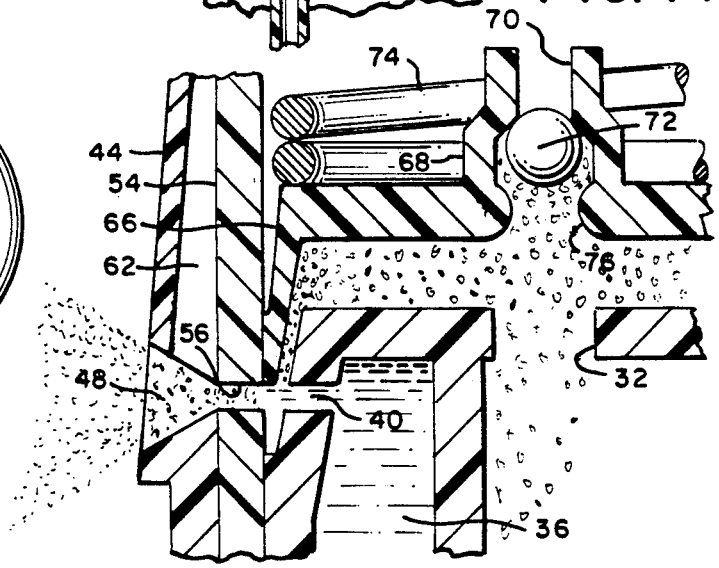

SQUEEZE SPRAYER DEVICE

BACKGROUND OF THE INVENTION

Inexpensive containers containing hair spray fluids, anti-perspirants and the like conventionally are pressurized with aerosols or other pressure gases so that upon dispensing, the fluids mixed with the gases are ejected as atomized sprays. Such gases have been found when released to damage the environment, so that a need has arisen for atomized sprayers which can produce the desired sprays without the use of such gases.

Moreover, known squeeze sprayers produce an atomized spray upon the admixture of air and liquid product at or near the discharge orifice. However, such sprayers, generally of complex construction and high cost, are ineffective in producing a fine mist spray.

SUMMARY OF INVENTION

The present invention is directed toward an improved inexpensive squeeze sprayer device containing an air piston, which does not use aerosols or other gases, and which shifts axially in response to squeezing pressure to uncover the discharge orifice and allow product liquid to be mixed and dispensed with air in a unique non-contaminating manner to produce sprays of the types desired. This device exhibits a self cleaning action as it sprays whereby it will not clog or jam during use. A discharge opening in alignment with the discharge orifice is wiped clean upon the return movement of the piston to thereby avoid product buildup at the orifice. The device is self sealing and will not leak when not in use. It can be manufactured and assembled easily and inexpensively. These and other advantages of this invention will either be explained or will become more apparent hereinafter.

In accordance with the principles of this invention, a squeeze sprayer device is adapted for use with a flexible container of liquid having an open neck. A closure member on the neck has an air opening in communication with an air space located above the liquid in the container. And, the member has a product discharge orifice extending through a side wall thereof forming a valve seat. The orifice extends from a conduit formed within the member at which a dip tube extending into the container is suspended.

A discharge valve in the form of an air piston is normally seated on the closure member and is disposed for axial shifting movement within a capped cylinder, or inner cap, between discharge open and closed positions. When closed, the piston seal covers the discharge orifice under the bias of a piston return spring. The piston is unseated to open or uncover the discharge orifice in response to pressurized air upon squeezing of the container. The air under pressure admixes with the liquid upon discharge through a discharge opening in the cylinder aligned with the orifice to cause particle breakup and thus issue as a fine mist spray. Also, clogging at the discharge is avoided, and product buildup at the discharge is lessened as the piston seal wipes the cap opening clean during shifting movement.

The piston has a valve controlled air vent for admitting air into the container through a top opening in the cap during each squeeze release of the container.

A shipping/storage overcap may be provided over the cap. The overcap snugly embraces the cap in a non-operative position for sealing the cap opening closed against leakage. And, a depending probe on the overcap extends through the top opening in the cap for bearing against the piston and plugging its air vent closed and for preventing piston reciprocation in the non-operative position. Upon overcap movement into an operative position, a discharge opening in the overcap is aligned with the cap discharge opening and the probe disengages from the piston air vent permit piston axial movement during spray use.

The overcap may be provided with an air passage extending from its discharge opening and in communication with the cylinder top opening in the operative position to thereby define a supplemental vent passage.

Thus, when the container is squeezed, with the overcap in its operative position, or without the provision of an overcap, air within the container is pressurized and unseals the piston to open the discharge and to facilitate admixture of pressurized air with product expelled through the discharge orifice. The piston vent valve closes permitting piston movement, and the pressurized air aids in discharge and cleaning in the discharge area.

When squeezing pressure is released, the piston is returned to its seated position by the return spring, and the piston seal wipes the cylinder discharge opening clean. Air is vented into the container through the piston air vent, and through the vent passage in the overcap. The dip tube remains primed as the piston closes the discharge so that the sprayer is ready for use in the next squeezing cycle. The sprayer is sealed during non-use as the piston seal covers the discharge orifice. In the storage and shipping position, the overcap prevents piston reciprocation despite attempts to squeeze the container, immobilizes piston movement and plugs the piston vent closed, and covers the cylinder discharge opening for sealing the sprayer against leakage.

More specifically, the device includes a hollow closure member having an upper end with an air opening and a lower open end. The upper end and an adjacent outer peripheral portion of the member defines a seat for a piston. The member contains a hollow conduit sealed at its upper end. The conduit has an open lower end which is adapted to receive a dip tube. The peripheral portion of the member has a discharge orifice communicating with the interior of the conduit.

A hollow piston has an upper end with a vent opening and is disposed above the member. The piston has a temporary raised postion at which the piston is out of engagement with the seat and a first air passage is formed interconnecting the discharge orifice and the air opening. The piston also has a normal lowered postion at which the piston engages the seat, closes the orifice and blocks the first air passage.

A spring cooperates with the piston and biases the piston in its lowered position. The piston has a one way valve means at its upper end. The valve means has a first position at which the vent opening is closed and air cannot flow downwards through the vent opening and through the air opening and has a second position at which the vent opening is opened and air can flow downward from the vent opening through the air opening. The valve means is in the first position when the piston is in raised position and is in the second position when the piston is in lowered position.

A cap mechanism includes an outer cap, or overcap, having a first discharge vent, an inner cap, or cylinder, with a closed end, having a second discharge vent and air venting means. The air venting means has open and closed positions. The mechanism encloses the piston, the spring, the valve means and the member and is adapted to engage the neck of the container in sealing relationship with the dip tube connected to the vertical conduit and extending below the level of liquid in the container.

The mechanism, when so engaged, has a first position at which the first and second discharge openings are out of alignment and the air venting means is closed and a second position at which the first and second discharge openings are aligned with each other and with the discharge orifice and the air venting means is open.

When the container is squeezed, with the mechanism in the second position, the piston is temporarily placed in raised position, the valve means is temporarily placed in its first position and air is expelled from the container into the member and along the first air passage to the discharge orifice to mix with liquid drawn out of the container and flowing upward through the dip tube and the conduit and out of the discharge orifice, thus forming a mixture of air and liquid which passes along the discharge path and out of the discharge opening as a spray.

When the squeezing pressure is released, with the mechanism in the second position, the piston immediately returns to its lowered position, the valve means returns to its second position, the air passage is blocked and return air flows through the open air venting means and the inner cap and the aligned openings into the interior of the body and into the container. The dip tube remains primed upon closing of the discharge by the piston so that the dispenser is ready for use in the next squeezing cycle. The device is sealed and fluid cannot leak out of the container.

The return air flow through the discharge before being reclosed by the piston, cleans any residue of the spray and liquid off of all surfaces and carries such residue and liquid back into the container, thus preventing any build up which could cause clogging and blockage during subsequent use.

BRIEF DESCRIPTION OF THE DRAWINGS

FIG. 1 is an exploded view of a preferred embodiment of the squeeze sprayer device.

FIG. 2 is a top view of the outer cap or overcap.

FIG. 3 is a cross sectional view of the outer cap take along line 3—3 in FIG. 2.

FIG. 4 is a top view of the inner cap or capped cylinder.

FIG. 5 is a cross sectional view of the inner cap taken along line 5—5 in FIG. 4.

FIG. 6 is a bottom view of the outer cap.

FIG. 7 is a bottom view of the inner cap.

FIG. 8 is a view taken along line 8—8 in FIG. 1.

FIG. 9 is a side elevational view of a completely assembled squeeze sprayer device.

FIG. 10 is a top view of the device of FIG. 9.

FIG. 11 is a detail cross sectional view showing the device in closed fluid sealing position.

FIG. 12 is a detail cross sectional view showing the device in open position just before the container is squeezed.

FIG. 13 is a detail cross sectional view illustrating the spray producing action while the container is squeezed.

FIG. 14 is an enlarged detail view illustrating the spray producing action while the container is squeezed.

FIG. 15 is a vertical cross sectional view of another type of one way valve which can be substituted for the one way valve shown in FIGS. 1, 11, 12, 13 and 14 and which shown in open position.

FIG. 16 is a bottom view of the valve shown in FIG. 15.

FIG. 17 is a vertical cross sectional view of yet another type of one way valve which can be substituted for either the valve shown in FIGS. 1, 11, 12, 13 and 14 or the valve shown in FIGS. 15 and 16 and which is shown in open position.

FIG. 18 is a bottom view of the valve shown in FIG. 17.

DETAILED DESCRIPTION OF PREFERRED EMBODIMENTS

In the embodiment shown in FIGS. 1–14, a plastic container having a collapsible wall(s) and an open neck 22 contains a liquid such as a household or personal care product. A hollow closure member 24 resembles a vertical drum, has a horizontal external ring 26 disposed intermediate its ends and has an external shoulder 28 extending horizontally midway between the ring 26 and the upper end 30. Shoulder 28 together with the adjacent outer peripheral portion 42 extending downwardly from the upper end to the shoulder defines a valve seat as will be explained in more detail below. End 30 has an air opening 32. Member 24 has an open lower end 34, and has a conduit 36 at which a dip tube 38 is suspended. Member 24 has a product discharge opening 40 extending though portion 42 from the conduit.

An overcap 44 overlies cap 54 (to be more fully described hereinafter) and extends into the neck of the container. Member 24 is fitted into the neck with ring 26 bearing against the inside of overcap 44. The part of member 24 which extends above ring 26 extends outwardly above the neck. Overcap 44 is rotatable in the neck about its vertical axis, and has a depending prong or probe 46 aligned with the overcap vertical axis. Overcap 44 has a discharge opening 48 in its side and has an air vent 50 in its top adjacent the prong. Overcap 44 has an internal groove or thread 52 in its inner wall and also has an elongated recess 62 in the inner wall communicating with opening 48.

An inner cap in the form of a capped cylinder 54 is disposed within overcap 44 and extends with its open end bearing against ring 26 between the overcap 44 and the member 24. Cap 54 has a discharge opening 56 in its side and has an external thread or groove 58 engaging groove or thread 52. Cap 54 has a top opening 60 through which prong 46 extends. The inner wall of cap 54 has four internally extending ridges 64 disposed at about right angles to each other.

A discharge valve in the form of an air piston 66, having an upper end 68 with a vent opening 70, is disposed within the inner cap above the closed end of the member 24. A ball 72 is disposed within a cage surrounding vent 70. The diameter of the ball is sufficiently large to prevent its passage through the opening 70.

A spring 74 is disposed within the inner cap and extends between the piston and ridges 64. The spring biases the piston into a normal lowered position (FIG. 11) at which the piston engages the seat and seals off opening 40 so that air or product cannot flow therethrough. Ball 72 is normally in its lowermost position within the ball cage and rests upon spaced prongs 76. During venting, air can flow around the ball and through the spaces between the ball and the prongs. During spraying, ball 72 is seated within vent opening 70 and defines a one way valve.

When the squeeze sprayer device is not in use, such as during shipping and storage, the caps are so oriented that openings 48 and 56 are mismatched and prong 46 bears against the piston for immobilizing it and plugs into sealing engagement with opening 70. The device will not leak since all openings through which fluid can escape are sealed. Air cannot flow into or out of the container. The inner cap engages and closes recess 62. This condition is shown in FIG. 11.

During use of the device, the overcap is rotated, raising prong 46 out of opening 70, and aligning openings 48 and 56. The piston remains seated. The rotation also opens recess 62 which then forms an air passage connecting opening 48 through opening 60 and air flowing therethrough can flow through opening 70 around the ball and through opening 32. Air can also flow through opening 50, opening 60, opening 70 and opening 32 into the container. This condition is shown in FIG. 12.

Upon squeezing the container, air within the container is pressurized and exerts a pressure which momentarily overcomes the spring bias, temporarily raising the piston and raising the ball to seal opening 70. This condition is shown in FIGS. 13 and 14. The piston seal is moved out of engagement with the seat and an air passage is formed which interconnects the outer end of discharge orifice 40 with opening 32. Opening 70 is closed, preventing air from flowing upwardly through opening 32 and opening 70. Opening 40 is connected to the aligned openings 48 and 56. Air in the container flows upwardly out of the opening 30, through the space between the raised piston and the upper end 30 of member 24 and into the region connecting opening 40 with the aligned openings 48 and 56. Liquid product is forced out of the container, through the dip tube and conduit 36 and out of opening 40 into this connecting region. As a consequence, the dip tube is primed with liquid. The air and liquid are mixed in this region to produce a spray discharge through opening 48. The upward air pressure forces the ball into its uppermost position and blocks the flow of air upwardly through the upper end of the piston.

As soon as the squeezing pressure is removed, the spring returns the piston to its seated position, the ball drops to its lowest position and opening 40 is closed. The dip tube remains primed with product as opening 40 is reclosed by the piston seal. Return air flows through vent 50 and the opening 60 (since prong 46 is raised as shown in FIG. 12) and continues to flow through opening 70 down and around the ball 72, and through opening 32 back into the container. Another path of return air is established via opening 48, recess 62, opening 60, opening 72 and opening 32. Depending upon the amount of return air needed, one of these two paths can be eliminated. The overcap can then be rotated to return the device to the position shown in FIG. 11. Since the dip tube remains primed, the device will spray immediately when subjected to the next squeezing cycle.

Some of the fluids used in this squeeze sprayer device can chemically attack the ball 72, which is a metal ball. In this situation, the ball type operation is eliminated by substituting either the valve shown in FIGS. 15 and 16 or the valve shown in FIGS. 17 and 18. All valves function in the same manner, and other one-way valves can be provided without departing from the invention.

FIGS. 15 and 16 show a duck type one way valve wherein a duck bill vent 74 having a slit 76 is disposed in the upper end of the piston below opening 70. The slit is normally open and is closed when squeezing pressure is applied.

FIGS. 17 and 18 show a flat plastic disc 80 supported by nibs 82. Air passages 84 are formed between the disc and the nibs. When squeezing pressure is applied, the disc is raised to bear against opening 70 and seal it. When the pressure is removed, the disc falls to engage the nibs, and air can flow around it.

While the invention has been described with specific reference to preferred embodiments, the protection sought is to be limited only by the terms which follow.

What is claimed:

1. A squeeze sprayer device adapted for use with a flexible container of liquid having an open neck, said device comprising;

a hollow closure member fitted in the neck and having an upper end with an air opening and a lower open end, said upper end and an adjacent outer peripheral portion of the member defining a seat for a hollow piston, said member containing a hollow conduit sealed at its upper end and having an open lower end adapted to receive a dip tube, said portion having a discharge orifice communicating with the interior of said conduit;

said hollow piston having an upper end with a vent opening and disposed above the member, the piston having a temporary raised position at which the piston is out of engagement with the seat and an air passage is formed interconnecting the discharge orifice and the air opening, the piston having a normal lowered position at which the piston engages the seat, closes the discharge orifice and blocks said air passage;

a spring cooperating with the piston, said spring biasing the piston to the lowered position;

one way valve means for controlling the vent opening and having a first position at which the vent opening is closed and air cannot flow downwards through the vent opening, said means having a second position at which the vent opening is opened and air can flow downward from the vent opening and through the air opening, said means being in the first position when the piston is in said raised position and being in the second position when the piston is in the lowered position;

a cap mechanism including an overcap having a first discharge opening, an inner capped cylinder having a second discharge opening and air venting means, the air venting means having open and closed positions, said mechanism enclosing said piston, said spring, said valve means and said member and being adapted to engage the neck of the container in sealing relationship with the dip tube connected to the conduit and extending below the level of liquid in the container, said mechanism when so engaged having a first position at which the first and second discharge openings are out of alignment and the air venting means is closed and a second position at which the first and second discharge openings are aligned with each other and with the discharge orifice and the air venting means is open;

when the container is squeezed, the mechanism is in the second position, the piston is temporarily placed in said raised position, the valve means is temporarily placed in its first position, the air venting means is closed, and air is expelled from the container into the member and along the air passage to the second opening to mix with liquid flowing upward from the container, through the dip tube and conduit and out of the discharge orifice, thus priming the dip tube with fluid and forming a mixture of air and liquid which passes through the aligned discharge openings and out of the discharge orifice as a spray;

when the squeezing pressure is released, with the mechanism in the second position, the piston returns to its lowered position, the valve means returns to its second position, the air passage is blocked, the air venting means is open, the dip tube remains primed with fluid, and return air flows through the valve means and the member into the container.

2. The device of claim 1 wherein the overcap and the cylinder have cooperating means enabling the overcap to be rotated about the inner cylinder to place the mechanism in either one of its first and second positions.

3. The device of claim 2 wherein the overcap has a vertical prong extending downwardly from the upper end thereof through a prong receiving opening in the upper end of the cylinder.

4. The device of claim 3 wherein the prong has a lower end engaging the upper end of the piston when the mechanism is in the first position, the lower end of the prong being spaced above the upper end of the piston when the mechanism is in the second position.

5. The device of claim 4 wherein the prong seals the prong receiving opening when the mechanism is in the first position and an air clearance space is established between the prong and the prong receiving opening when the mechanism is in the second position.

6. The device of claim 5 wherein the member has a portion below the seat which extends into the neck of the container.

7. The device of claim 6 wherein the portion of the member below the seat has an outer horizontal ring.

8. The device of claim 7 wherein both the overcap and the cylinder have lower ends disposed in the neck, the ring bearing against the lower end of the overcap which bears against the neck, the lower end of the inner cap resting upon the ring.

9. The device of claim 8 wherein the cooperating means includes a groove and a thread engaging the groove, one of the thread and groove being disposed on the inner surface of the overcap, the other of the thread and groove being disposed on the outer surface of the cylinder.

10. The device of claim 9 wherein the one way valve means includes a moveable ball.

11. The device of claim 9 wherein the one way valve means includes a slitted duck bill vent.

12. The device of claim 9 wherein the one way valve means includes a flat disc.

13. The device of claim 9 wherein the air venting means includes an air vent in the overcap.

14. The device of claim 9 wherein the air venting means includes the prong receiving opening.

15. A squeeze sprayer, comprising:

a flexible container of liquid product:

closure means adapted to be connected to said container, said closure means having a product discharge orifice;

conduit means connected to said closure means for conveying liquid to said discharge orifice;

a dip tube connected to said conduit means for conveying the liquid from said container to said conduit means;

atomizing means connected to said closure means and having first container vent means, said atomizing means comprising a hollow cylinder having a closed end wall, and a first discharge opening in alignment with said orifice;

said atomizing means further comprising axially movable and spring biased valve means mounted within said cylinder in communication with air within the container, said valve means covering said discharge orifice in a discharge closed position, and said valve means being moved axially away from said closure means in response to pressurization of the air within the container upon squeezing for thereby uncovering said discharge orifice in a discharge open position and for admixing the pressurized air with the liquid product issuing from the discharge orifice to produce a fine mist spray of the product from said discharge opening.

16. The sprayer according to claim 15, wherein said first vent means comprise a vent hole in said cylinder, and a one-way valve controlled vent opening in said valve means.

17. The sprayer according to claim 15, wherein spring means is provided within said cylinder for returning said valve means from said discharge open position to said discharge closed position upon removal of squeeze pressure to the container.

18. The sprayer according to claim 15, further comprising an overcap movably connected to said cylinder, a second discharge opening in said overcap alignable with said first discharge opening, and said overcap having second container vent means in communication with said first vent means.

19. The sprayer according to claim 18 wherein said first vent means comprise a vent hole in said cylinder, and a one-way valve controlled vent opening in said valve means, said overcap having a probe extending into said cylinder through said vent hole and plugging into said vent opening for immobilizing said valve means in said discharge closed position.

20. The sprayer according to claim 18 wherein said second vent means comprises an internal air passage formed in said overcap in communication with said second discharge opening.

21. The sprayer according to claim 18, wherein said second vent means comprises a vent opening in said overcap.

22. The sprayer according to claim 15, wherein said valve means comprises an air piston having a piston seal sliding along said first discharge opening between said discharge closed and open position.

23. The sprayer according to claim 18, wherein said overcap snugly embraces said cylinder in a non-use position, said cylinder and said overcap having cooperating thread and groove means to permit alignment of said first and second discharge openings and to permit axially shifting movement of said overcap relative to said cylinder into a use position.

24. A squeeze sprayer, comprising:

a flexible container of liquid product;

closure means connectable to said container, said closure means having a discharge orifice through which liquid from the container is sprayed;

dip tube means connected to said closure means for conveying liquid from said container to said orifice upon squeezing the container;

means for atomizing the sprayed liquid, comprising a closed end hollow cylinder fixedly connected to said closure means and having a first discharge opening in fixed alignment with said orifice;

said atomizing means further comprising air valve means covering said orifice in a discharge closed position and being axially moveable against the bias of a return spring within said cylinder in response to an increase in air pressure within said container upon the squeezing for uncovering said orifice in a discharge open position and for conveying pressurized air to the liquid spray to create a fine mist spray.

25. The sprayer according to claim 24, wherein said atomizing means has first vent means comprising a vent hole in said cylinder and a one-way valve controlled vent opening in said valve means.

26. The sprayer according to claim 24, wherein said valve means comprises an air piston having a piston seal which covers and uncovers said orifice in said closed and open positions.

27. The sprayer according to claim 24, further comprising an overcap movably connected to said cylinder and having a second discharge opening alignable with said first opening, a probe on said overcap bearing against said valve means for immobilizing said valve means in a position of, non-use.

28. The sprayer according to claim 25, further comprising an overcap moveably connected to said cylinder and having a second discharge opening alignable with said first opening, said atomizing means having first vent means comprising a vent hole in said cylinder and a one-way valve controlled vent opening in said valve means, said overcap having second vent means in communication with said first vent means in an aligned position of said first and second openings.

* * * * *